US006698749B2

(12) United States Patent
Müller

(10) Patent No.: US 6,698,749 B2
(45) Date of Patent: Mar. 2, 2004

(54) DEVICE FOR FEEDING FOLDED OR UNFOLDED SIGNATURES TO A PRODUCTION LINE

(75) Inventor: Hans Müller, Zofingen (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/964,406

(22) Filed: Sep. 28, 2001

(65) Prior Publication Data

US 2002/0041067 A1 Apr. 11, 2002

(30) Foreign Application Priority Data

Oct. 5, 2000 (EP) ..... 00810921

(51) Int. Cl.[7] ..... B65H 3/08

(52) U.S. Cl. ..... 271/99; 271/11; 271/12; 271/100; 271/101; 271/106; 271/91

(58) Field of Search ..... 271/11, 12, 99, 271/100, 101, 106, 91

(56) References Cited

U.S. PATENT DOCUMENTS

| | | | | | |
|---|---|---|---|---|---|
| 3,100,110 | A | * | 8/1963 | Winkler et al. | 271/104 |
| 3,586,316 | A | * | 6/1971 | Ehlscheid et al. | 271/98 |
| 3,599,970 | A | * | 8/1971 | Smithe et al. | 271/95 |
| 3,650,525 | A | * | 3/1972 | Hageman et al. | 271/101 |
| 3,790,163 | A | * | 2/1974 | Helm | 271/165 |
| 3,921,523 | A | * | 11/1975 | Jahme | 101/232 |
| 3,973,767 | A | * | 8/1976 | Kramer | 271/12 |
| 4,071,234 | A | * | 1/1978 | Schick | 271/11 |
| 4,358,100 | A | * | 11/1982 | Muller | 271/11 |
| 4,542,895 | A | * | 9/1985 | Blumle | 271/101 |
| 5,014,973 | A | * | 5/1991 | Markert | 271/100 |
| 5,028,043 | A | * | 7/1991 | Karolyi | 271/14 |
| 5,028,044 | A | * | 7/1991 | Fischer | 271/91 |
| 5,054,761 | A | * | 10/1991 | Dietrich et al. | 271/95 |
| 5,080,341 | A | | 1/1992 | Luethy | |
| 5,120,041 | A | * | 6/1992 | Schniter | 271/107 |
| 5,613,670 | A | * | 3/1997 | Ballestrazzi et al. | 271/3.23 |
| 5,664,770 | A | * | 9/1997 | Keller | 271/3.11 |
| 6,015,145 | A | | 1/2000 | Hartel | |
| 6,042,102 | A | * | 3/2000 | Raschke et al. | 271/12 |
| 6,070,866 | A | * | 6/2000 | Wepfer | 271/10.11 |

FOREIGN PATENT DOCUMENTS

| | | | | |
|---|---|---|---|---|
| CH | 598 107 | | 4/1978 | |
| DE | 33 00 295 | | 7/1984 | |
| WO | WO 9613452 | A1 * | 5/1996 | B65H/5/12 |

* cited by examiner

*Primary Examiner*—Donald P. Walsh
*Assistant Examiner*—Matthew J. Kohner
(74) *Attorney, Agent, or Firm*—Venable LLP; Robert Kinberg; Jung H. Kim

(57) ABSTRACT

A feeder device for removing folded or unfolded signatures from a stack of signatures in an adjacent signature magazine and feeding a production line with the signatures. The device includes a conveying rotor having an approximately circular circumference and being rotatable in a conveying direction. The conveying rotor includes a recess at the approximately circular circumference for holding a front edge, in the conveying direction, of a printed product removed from the stack of signatures. A conveying belt partially rests against the circumference of the conveying rotor, and is drivable in the same direction as the conveying rotor, and together with the conveying rotor forms a conveying gap through which the signatures are conveyed to the processing line. At least one synchronously driven separating element includes a control device comprising a pivotal control shaft arranged parallel to the rotational axis of the conveying rotor. At least one suction head is coupled to a vacuum source and attached to the pivotal control shaft for partially lifting a signature off the stack of signatures by applying a suctioning effect to the front edge of the signature to transfer the signature to the recess of the conveying rotor.

16 Claims, 3 Drawing Sheets

DEVICE FOR FEEDING FOLDED OR UNFOLDED SIGNATURES TO A PRODUCTION LINE

CROSS-REFERERNCE TO RELATED INVENTION

Priority is claimed herein with respect to European Patent Application No. 00810921.7, filed in the European Patent Office on Oct. 5, 2000, the subject matter of which is incorporated herein by reference.

BACKGROUND OF THE INVENTION

The invention relates to a device for feeding folded or unfolded signatures to a production line. Such a device includes a conveying rotor that removes stacked signatures from an adjacent signature magazine and which is provided with a recess along the approximately circular circumference. The signature is partially lifted off the stack by a synchronously driven separating member by applying suction to the signature front edge in the conveying direction. The recess in the conveying rotor functions to hold the front edge of a signature and forms a conveying gap together with a conveying belt that makes contact along parts of the circumference and is moved in the same direction.

A device of this type is disclosed, for example, in Swiss Patent CH-A-598 107 and is used for a faster processing of the increasingly higher numbers of signatures. The aforementioned reference provides for a mutually interacting pair of suction devices on the stack front, used for the preliminary separation of the signatures. Thus, a signature gripped at the front edge by respectively one suction device, can be transferred to a conveying rotor provided with several recesses along the circumference and can be further deflected by the latter around a deflection roller located below the stack and in the direction of dropping off. The signature is withdrawn by being carried along between the conveying rotor and the deflection roller, so that after one signature has dropped off, the following suction device can grip the following signature by the fold.

On the one hand, it is questionable whether an increase in output can be achieved with this embodiment when on the other the reliability is reduced.

SUMMARY OF THE INVENTION

It is an object of the present invention to create a device of the aforementioned type, which makes it possible to achieve an increase in output along with a high degree of reliability.

This object is solved according to the invention in that the separating element is provided with at least one suction head that is connected to a vacuum source. The suction head is attached to a control device control shaft, which is positioned parallel to the rotational axis of the conveying rotor and is attached to it, such that it can pivot. A structurally simple embodiment can be created in this way.

BRIEF DESCRIPTION OF THE DRAWINGS

The invention is subsequently explained further with the aid of two exemplary embodiments and by referring to the drawing, to which the reader is referred for all details not mentioned expressly in the description.

DETAILED DESCRIPTION OF THE INVENTION

Figure 1:
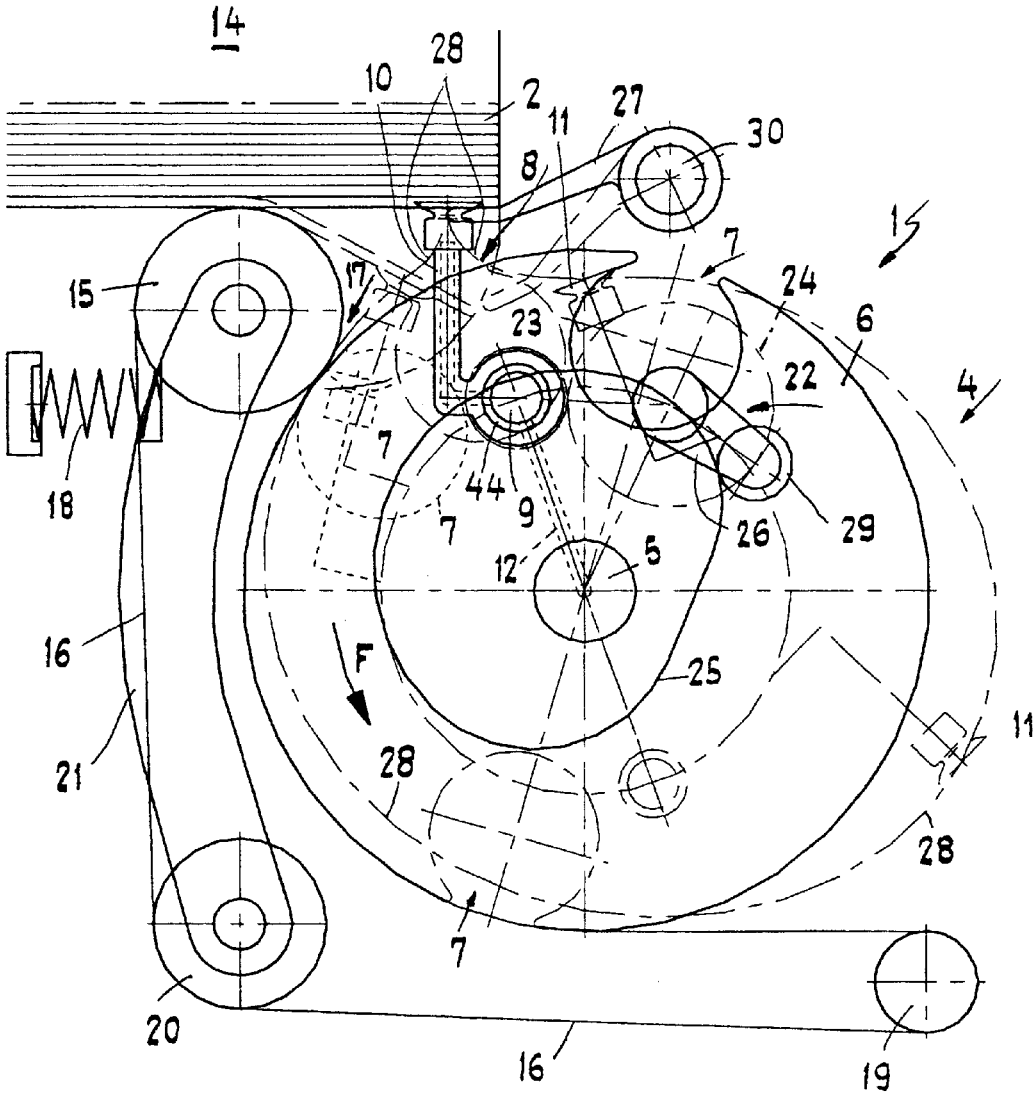
FIG. 1 is a front view of a schematic representation of the device according to the invention.

FIG. 1 illustrates a device 1 for feeding a production line with folded or unfolded signatures 2, e.g. a feeder for a gathering and wiring stitching machine, an assembling machine for producing adhesive-bound books or a machine for placing inserts into newspapers. The device or feeder 1 comprises a conveying rotor 4 that rotates inside a frame 3 (see FIG. 3) and consists of a rotor shaft 5 with thereon attached conveying discs 6 that form a rotor. Each conveying disc 6 is provided along the circumference with two opposite arranged recesses 7, which are arranged such that they are aligned one after another and parallel to the rotor shaft 5 if viewed over three conveying discs 6. Respectively one separating element 8 is furthermore assigned to the recesses 7 that are arranged in a row. The separating element 8 is provided with several suction arms 10, attached to a separating shaft 9, which is positioned parallel to the rotor shaft 5 inside the conveying discs 6. The suction arms have suction heads 11 that act upon the front edge in conveying direction F of a folded or unfolded signature 2. The suction heads 11, which are connected to a non-visible vacuum source, are supplied via a line 12 with a vacuum that is controlled, for example, with a rotary-spool valve 13 (see FIG. 3). The signatures 2, stacked in an adjacent magazine 14, are gripped by the suction heads 11 that rotate along with conveying rotor 4. They are gripped at the folded, projecting edge facing the conveying rotor 4, that is to say at the underside or front side of a signature 2 in the stack. During the removal in the form of a scaled flow, the signatures 2 are deflected in a downward direction around the deflection roller 15 that functions as a supporting element. In that way, the front edge of the signature 2 that is lifted off by the separating element 8 dips into the subsequent recess 7 without being released from the separating element 8. This rotating along of the separating element 8 is shown in FIG. 1 with dashed lines in the effective range for the separating element 8. The separating element 8 detaches from the front edge of the signature 2 as soon as this signature is gripped by an intake gap 17, formed by the conveying discs 6 of conveying rotor 4 and one or several conveying belts 16 that rotate around the deflection roller 15, and is conveyed further.

If the signatures 2 are to be separated during the removal from the magazine 14, the deflection roller 15 is no longer needed as a supporting member on the underside of the stack. A conveying gap covering a range of approximately 120° is formed with the conveying belt(s) 16, which circulates (circulate) around the deflection roller 15 and move(s) in the same direction along the circumference of the conveying rotor 4. This conveying gap can be adapted to a changing scaled flow, with respect to height, as a result of the deflection roller 15 that supports itself on a spring 18. The conveying belt(s) 16 is (are) guided around three deflection rollers 15, 19, 20, of which the roller 20 is positioned on a tensioning lever 21 for tensioning the conveying belt 16. The separating element(s) 8, rotating along with the conveying rotor 4, is (are) drive-connected to a control device 22. For this, the control shaft 9 is provided at one end with a pinion gear 23, which meshes with an additional toothed wheel 24 that is positioned on the conveying rotor 4. A control lever 26 embodied as a detection member is positioned on the toothed wheel 24 and engages in a locally fixed (kidney-shaped) control track 25 that is connected to the frame 3, by a freely turning roller 29 attached at the free end of control lever 26. FIG. 1 shows a separating element 8 with a suction head 11 attached to the lowest signature 2, as well as the respective position of the control device 22. Immediately following this, a holding catch 27 that supports the stacked signatures 2 in the frontal edge region is pivoted downward (dash-dot position), so that the signature 2 that is suctioned against the separating element 8 can be pivoted at the folded edge around the deflection roller 15 and downward. As soon as the front edge is submerged at the circumference of conveying rotor 4 or has dipped into the recess 7, assigned to the respective signature 2, the holding catch or catches 27 rotate(s) back to the supporting operating position. The further course of the separating element 8 and the recess 7 and their position is shown with dashed line in FIG. 1. In the process, it becomes obvious that the separating element 8 has more time and space available for transferring a signature 2 to the conveying rotor 4, than is possible according to the CH-A-598 107. The movement path of a suction head 11 is given the reference 28 in FIG. 1. The suction head(s) 11 is (are) located within the circumference of the conveying rotor 4, from the moment the signature 2 is taken over at the intake gap 17 to the moment of discharge at the end of the conveying gap.

At the intake gap 17, the movement direction for a signature 2 that is to be removed or deflected changes from a counter-rotating movement to movement in the same direction, relative to the rotational direction F of conveying rotor 4.

The suction arms 10, through which the vacuum is supplied, are attached at a right angle to the control shaft 9, that is formed by a (circular) hollow space 44, connected to the vacuum line 12 (FIG. 1). The connection to the suction heads 11 could also be realized in a radial direction to the pivoting axis of the control shaft 9, forming an acute angle of less than 30°.

The shaft 30, provided for actuating the holding catches 27, is positioned parallel to the rotor shaft 5 and the control shaft 9 inside the frame 3. Shaft 30 is provided on one end with a lever 31 that is pivoted via a roller 33 by a rotating cam disc 32 is positioned on the rotor shaft 5. A toothed wheel 34 at the end of rotor shaft 5 drives the rotor shaft 5.

Figure 2:
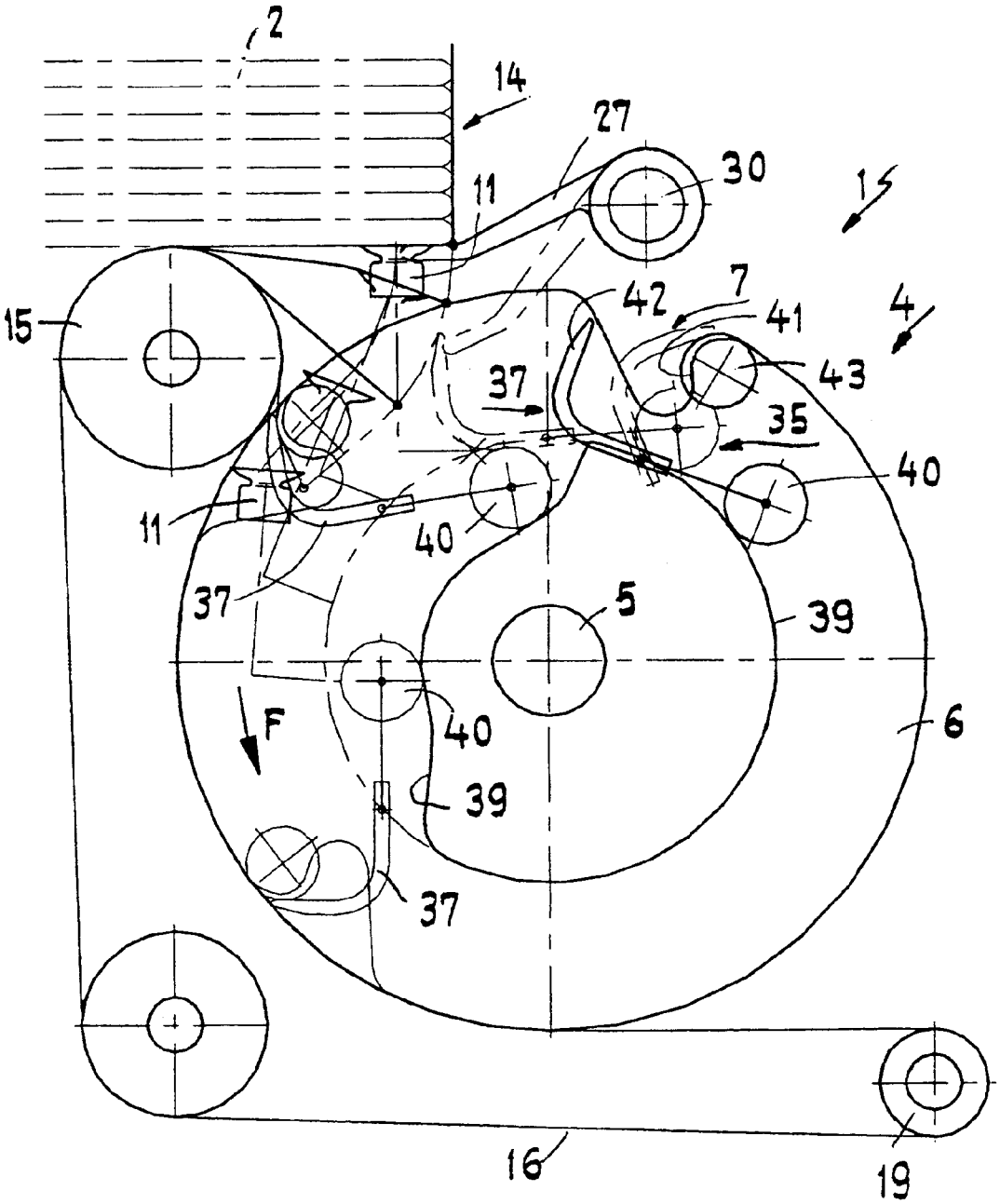
FIG. 2 is a view similar to FIG. 1 showing an alternative embodiment of the device according to the invention.
Figure 3:
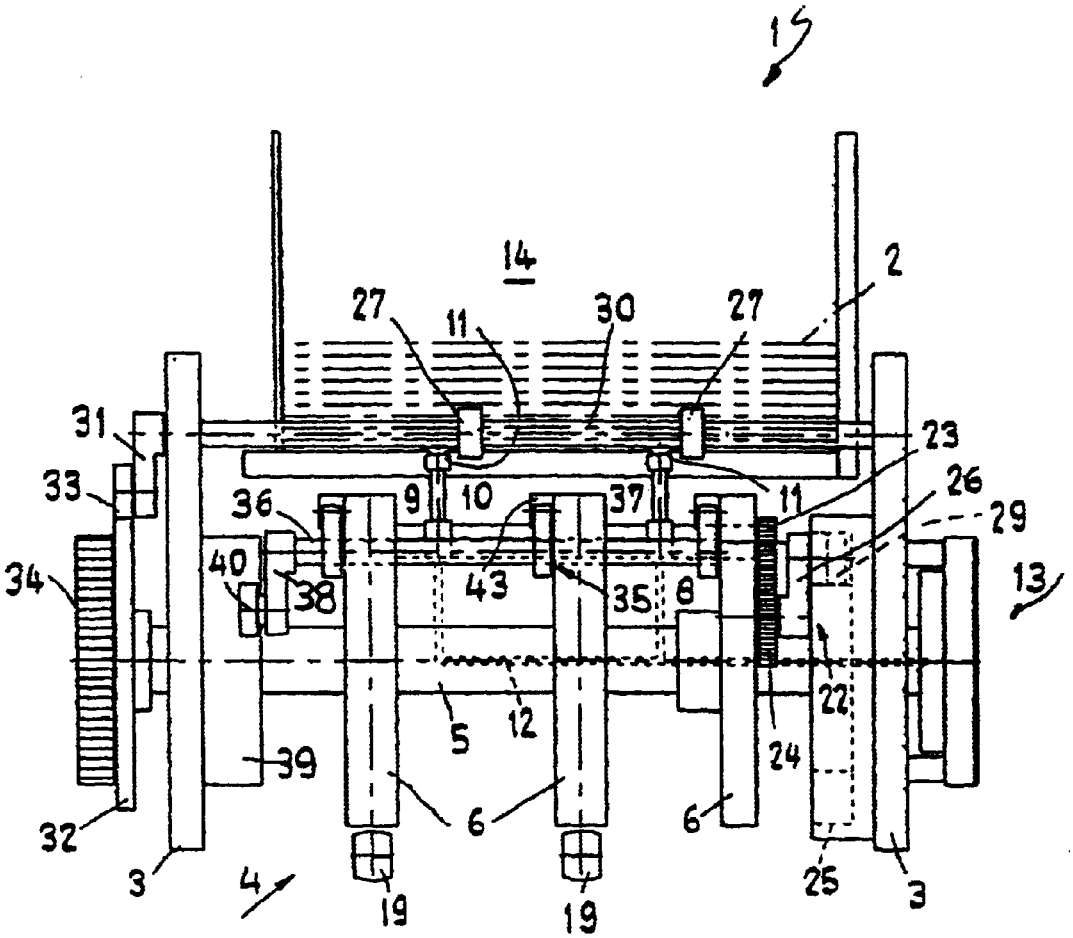
FIG. 3 is a view from the side of the device shown in FIG. 2.

FIGS. 2 and 3 show an alternative embodiment, wherein the embodiment shown in particular differs from the embodiment shown in FIG. 1 by an additional, controlled gripping device 35. The gripping device 35 comprises a gripping shaft 36, which extends inside the conveying discs 6, parallel to the rotor shaft 5, and is provided, for example, with three gripping arms 37. The pivoting movements of the gripping shaft 36, which are required for the open or closed position of the gripping device 35, are executed with a gripping lever 38 that is attached to the gripping shaft end. They are realized by means of a control roller 40 that is positioned on the free end of lever 38 and which circulates on a locally fixed control track 39. Control track 39 is connected to frame 3. The recesses 7 along the circumference of the conveying rotor 4 or the conveying discs 6 have a pocket-shaped design with an expanded access opening, so that the signatures 2 that are deflected at the suction heads 11 can directly dip into the counter-rotating recess 7. The wall 41 of recess 7 that follows in rotating direction F functions as a gripping support if the gripping device 35 is closed. For this, the gripping arms 37 have an end section 42, bent at a right angle, which ensures a movement of the gripping arms 37 within the circumference of the conveying rotor 4. The gripping support could also be, for example, a roller 43 that is positioned on the conveying discs 6 and acts in the manner of an anvil.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A feeder device for removing folded or unfolded signatures from a stack of signatures in an adjacent signature magazine and feeding a production line with the signatures, comprising:

a conveying rotor having an approximately circular circumference and being rotatable in a conveying direction, the conveying rotor including a recess at the approximately circular circumference for holding a front edge, in the conveying direction, of a signature removed from the stack of signatures;

a conveying belt partially resting against the circumference of the conveying rotor, being drivable in the same direction as the conveying rotor and together with the conveying rotor forming a conveying gap through which the signatures are conveyed to the processing line;

at least one synchronously driven separating element including a control device comprising a pivotal control shaft attached to the conveying rotor and arranged parallel to the rotational axis of the conveying rotor, and at least one suction head coupled to a vacuum source and attached to the pivotal control shaft for partially lifting a signature off the stack of signatures by applying a suctioning effect to the front edge of the signature to transfer the signature to the recess of the conveying rotor;

a locally fixed control track; and a sensing element arranged to circulate along the locally fixed control track and connected to the control shaft.

2. The device according to claim 1, wherein the sensing element comprises a lever having a free end and a contact roller attached at the free end.

3. The device according to claim 1, wherein, in a region where the signatures are removed from the stack of signatures, the respective signatures have a movement direction that changes from a counter-rotating movement to a movement in the same rotating direction as the conveying direction of the conveying rotor.

4. The device according to the claim 1, wherein the separating element has a non-operational position and is controlled to be displaced within the circulation path of the conveying rotor.

5. The device according to claim 1, wherein the suction head is oriented approximately perpendicular to an underside of the stack of signatures when the suction head is to lift off the printed product and during the suctioning forms an acute angle of less than 30° with a plane defined by the rotational axes of the conveying rotor and the control shaft.

6. The device according to the claim 1, wherein the conveying belt is arranged to be flexible in an intake region of the conveying gap.

7. The device according to claim 1, wherein the conveying gap extends over an area of approximately 120° along the circumference of the conveying rotor.

8. A feeder device for removing folded or unfolded signatures from a stack of signatures in an adjacent signature magazine and feeding a production line with the signatures, comprising:

a conveying rotor having an approximately circular circumference and being rotatable in a conveying direction, the conveying rotor including a recess at the approximately circular circumference for holding a front edge, in the conveying direction, of a signature removed from the stack of signatures;

a conveying belt partially resting against the circumference of the conveying rotor, being drivable in the same direction as the conveying rotor and together with the conveying rotor forming a conveying gap through which the signatures are conveyed to the processing line; and at least one synchronously driven separating element including a control device comprising a pivotal control shaft attached to the conveying rotor and arranged parallel to the rotational axis of the conveying rotor, and at least one suction head coupled to a vacuum source and attached to the pivotal control shaft for partially lifting a signature off the stack of signatures by applying a suctioning effect to the front edge of the signature to transfer the signature to the recess of the conveying rotor, wherein the at least one separating element comprises at least two separating elements.

9. A feeder device for removing folded or unfolded signatures from a stack of signatures in an adjacent signature magazine and feeding a production line with the signatures, comprising:

a conveying rotor having an approximately circular circumference and being rotatable in a conveying direction, the conveying rotor including a recess at the approximately circular circumference for holding a front edge, in the conveying direction, of a signature removed from the stack of signatures;

a conveying belt partially resting against the circumference of the conveying rotor, being drivable in the same direction as the conveying rotor and together with the conveying rotor forming a conveying gap through which the signatures are conveyed to the processing line;

at least one synchronously driven separating element including a control device comprising a pivotal control shaft attached to the conveying rotor and arranged parallel to the rotational axis of the conveying rotor, and at least one suction head coupled to a vacuum source and attached to the pivotal control shaft for partially lifting a signature off the stack of signatures by applying a suctioning effect to the front edge of the signature to transfer the signature to the recess of the conveying rotor; and a gripping device pivotally connected to the conveying rotor and associated with the recess, wherein the gripping device is actuatable counter to the rotation of the conveying rotor in the conveying direction for clamping in the front edge of the signature supplied to the recess.

10. The device according to claim 9, wherein the gripping device comprises a gripping shaft and gripping arms attached to the gripping shaft, said gripping shaft being arranged parallel to the rotational axis of the conveying rotor and pivotably mounted on both sides of the conveying rotor, wherein the gripping arms have open and closed positions; and the device further includes a stationary control track and a sensing element connected to the gripping shaft and circulating around the stationary control track for controlling the position of the gripping arms.

11. The device according to claim 9, wherein the recess is pocket-shaped and has an expanded access opening for the signatures.

12. The device according to claim 11, wherein the recess has a wall which follows in the conveying direction and comprises a gripping support for the gripping device.

13. The device according to claim 12, wherein the gripping arms comprise an end section bent at a right angle in the direction of a closing movement of the gripping arms.

14. The device according to claim 13, wherein the gripping support comprises a roller.

15. The device according to claim 9, wherein the effective range for the gripping device is within the circumference of the conveying rotor.

16. A feeder device for removing folded or unfolded signatures from a stack of signatures in an adjacent signature magazine and feeding a production line with the signatures, comprising:

a conveying rotor having an approximately circular circumference and being rotatable in a conveying direction, the conveying rotor including a recess at the approximately circular circumference for holding a front edge, in the conveying direction, of a signature removed from the stack of signatures;

a conveying belt partially resting against the circumference of the conveying rotor, being drivable in the same direction as the conveying rotor and together with the conveying rotor forming a conveying gap through which the signatures are conveyed to the processing line;

at least one synchronously driven separating element including a control device comprising a pivotal control shaft attached to the conveying rotor and arranged parallel to the rotational axis of the conveying rotor, and at least one suction head coupled to a vacuum source and attached to the pivotal control shaft for partially lifting a signature off the stack of signatures by applying a suctioning effect to the front edge of the signature to transfer the signature to the recess of the conveying rotor; and a deflection roller around which the conveying belt travels to form an intake gap together with the conveying rotor to deflect the signatures that are gripped by the separating element along the front edge in conveying direction.

* * * * *